United States Patent [19]

Del Guidice et al.

[11] Patent Number: 5,026,305

[45] Date of Patent: Jun. 25, 1991

[54] CONNECTOR FOR REED SWITCH OR SIMILAR ELECTRICAL COMPONENT

[75] Inventors: Henry L. Del Guidice; George H. Foster, Jr., both of Winston-Salem, N.C.

[73] Assignee: AMP Incorporated, Harrisburg, Pa.

[21] Appl. No.: 546,489

[22] Filed: Jun. 28, 1990

[51] Int. Cl.[5] ..... H01R 13/66

[52] U.S. Cl. ..... 439/620; 439/404

[58] Field of Search ..... 439/395, 396, 397, 398, 439/399, 400, 402, 403, 404, 620, 621, 622; 200/51 R

[56] References Cited

U.S. PATENT DOCUMENTS

| | | | |
|---|---|---|---|
| 4,118,098 | 10/1978 | Swift | 439/620 |
| 4,206,962 | 6/1980 | Shue, Jr. et al. | 439/620 X |
| 4,221,451 | 9/1980 | Petrelewicz et al. | 439/620 X |
| 4,679,885 | 7/1987 | Nestor et al. | 439/620 |
| 4,820,190 | 4/1989 | Humphrey | 439/395 |

OTHER PUBLICATIONS

IBM Technical Bulletin, vol. 4, No. 11, Depew, Pluggable Reed Relay Package, 4–1962.

HASCO Components, Inc., catalog showing reed relays and reed switches.

*Primary Examiner*—Neil Abrams

*Assistant Examiner*—Khiem Nguyen

*Attorney, Agent, or Firm*—Frederick W. Raring

[57] ABSTRACT

Connector for a reed switch comprises a cylindrical connector body having two stamped and formed contact members thereon. One of the contact members has a wire receiving slot adjacent to a first end of the switch body for one of the switch leads. The other contact member has a wire receiving slot adjacent to the second end for the other switch lead. Both contact members have slots for external conductors at the first end. An inserter is slidably mounted on the first end for pushing external conductors into the slots which receive the external conductors. The switch body has excess lead storage portions at each end for storing portions of the leads which extend beyond the lead wire slots. A housing encloses the switch body and has an opening through which the inserter projects.

21 Claims, 5 Drawing Sheets

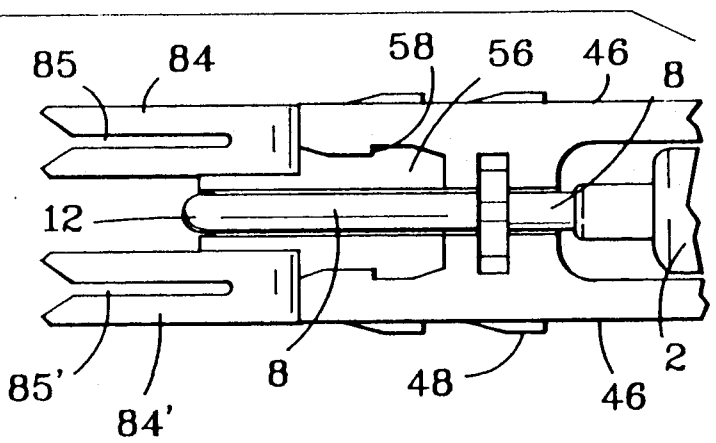
FIG. 10
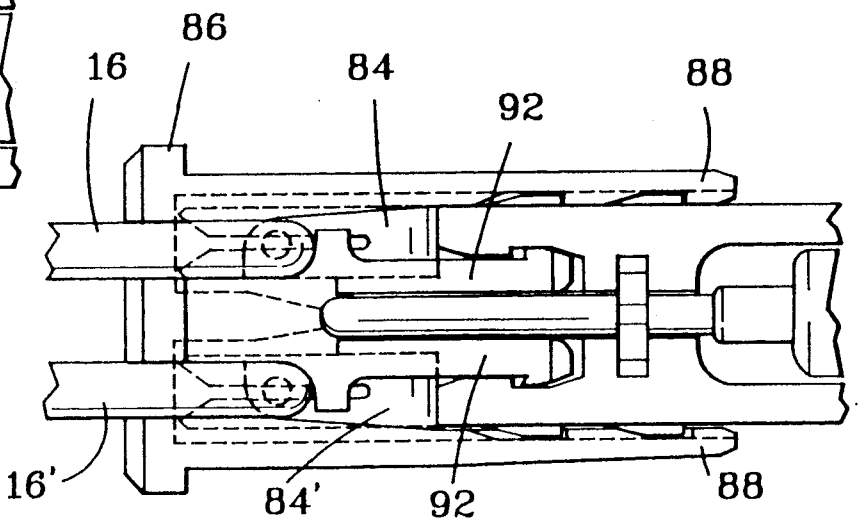
FIG. 12
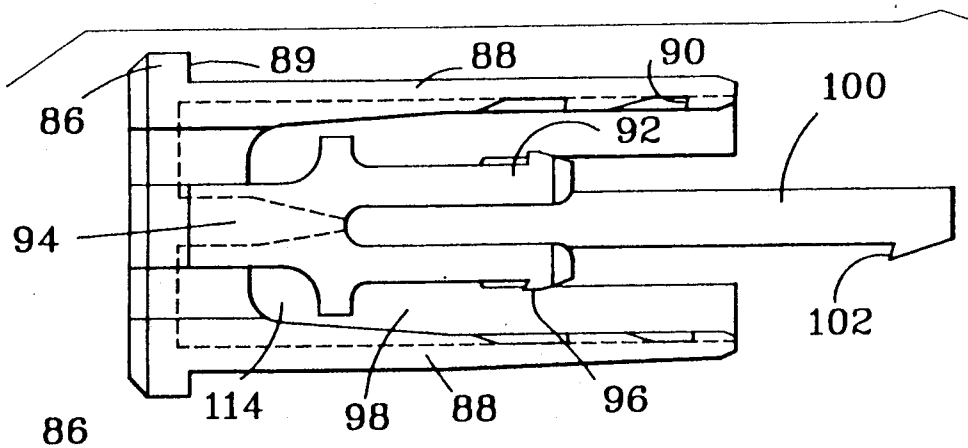
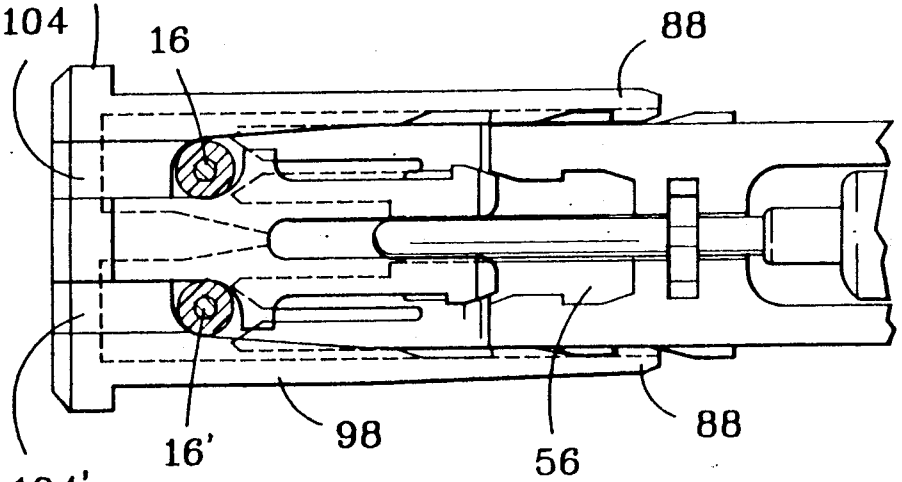
FIG. 11

CONNECTOR FOR REED SWITCH OR SIMILAR ELECTRICAL COMPONENT

FIELD OF THE INVENTION

This invention relates to connectors for electrical components such as reed switches and particularly to connectors which protect the switch and simplify the task of connecting external conductors to the switch leads.

BACKGROUND OF THE INVENTION

A reed switch comprises a cylindrical switch body having wire leads extending axially from the opposite ends of the body. When the switch is placed in service, it is merely necessary to connect the external conductors, in the circuit in which the switch is being placed, to the wire leads.

In order for the switch to function properly when placed in service, a degree of care must be exercised in handling the switch and connecting the external circuit conductors to the switch leads. If, for example, it is necessary to trim the switch leads, the operation must be carried out carefully to avoid breaking the hermetic seal between the leads and the switch body. Also, the leads should not be trimmed or cut beyond some minimum point so that a minimum amount of lead wire extends from the ends of the switch body. Additionally, the amount by which the leads are trimmed should be such that the two leads, after being trimmed, are of the same length. The latter requirement stems from the fact that the leads are part of the magnetic circuit and if they are of unequal lengths or if trimming is carried out carelessly, the characteristics of the switch will be altered and it will not perform as intended; see page 19 of catalogue 7500/1187 issued by Hasco Components, Inc., 247-40 Jericho Turnpike, Bellerose Village, NY 11001.

The manufacturers of reed switches are thus dependent upon the technician who places the switch in service if their switches are to perform in an optimum manner. Careless handling and careless trimming of the leads will cause the switch to perform in a substandard manner.

The present invention is directed to the achievement of a connector for a reed switch which encloses and protects the switch when it is being installed, which permits the connections to the switch leads to be made at a precisely predetermined location on the leads with respect to the ends of the switch body, and which simplifies the task of connecting the external conductors to the switch leads. The invention is further directed to the achievement of a connector which will avoid the necessity of trimming the switch leads so that the possibility of damage as a result of careless trimming is completely avoided.

THE INVENTION

The invention comprises a connector for connecting first and second external conductors to first and second leads which extend from an electrical component such as a reed switch. The component comprises a component body having opposite component body ends and first and second leads extending from the component body end. The connector comprises a connector body and first and second contact members. The connector body has first and second connector body ends and a component receiving cavity which is between the connector body ends. The first and second lead receiving channels extend from the cavity towards the first and second connector body ends and first and second contact recesses extend into the connector body and intersect the first and second channels. Each of the contact members has a lead contacting portion at one end thereof, an external conductor contacting portion at the other end, and an intermediate portion which extends between the ends. The lead contacting portions are in the first and second contact recesses. The intermediate portions extend from the recesses to a location proximate to the first end so that the external conductor contacting portions are at the first end. Upon placement of the component in the cavity and placement of the first and second leads in the first and second channels, the first and second leads will be connected to the first and second contact members, and the first and second external conductors can thereafter be connected to the external conductor contacting portions of the first and second contact members.

In accordance with the preferred embodiment, the first and second contact recesses are spaced from the cavity by the same distance so that electrical contact between the first and second leads and the lead contacting portions of the first and second contact members is established at the same distance from the first and second ends of the component. In accordance with a further embodiment, the connector body has first and second excess lead storage means at the first and second ends of the connector body for storing the excess portions of the leads which extend beyond the first and second contact recesses. The first excess lead storage means comprises a groove which extends from the first contact recess to, and across, the first connector body end and then back towards the second connector body end. The second excess lead storage means comprises a circumferential storage recess in the connector body which is located between the second contact recess and the second body end so that excess portions of the second lead can be coiled or wrapped in the circumferential recess. The contact members are, in the preferred embodiment, of stamped and formed sheet metal and the means for establishing contact with the external conductors and with the leads comprises wire receiving slots.

A conductor inserter is also preferably provided on the connector body at the first end. The inserter is in partially assembled relationship to the connector body and is movable to a fully assembled position. The inserter has inserting means or stuffers thereon for inserting the first and second external conductors into the external conductor contacting means when the inserter is moved to its fully assembled position.

In accordance with a further embodiment, the invention comprises a connector as generally described above and a reed switch or the like located in the cavity of the connector body with the leads connected to the contact members and with the inserter in its partially assembled position.

THE DRAWING FIGURES

FIGS. 3, 4, 5, 6, 7, and 8 are views looking in the direction of the correspondingly numbered arrows in FIG. 2, FIGS. 3-8 showing the contact members and the leads in the connector body.

FIG. 9 is a sectional side view of the first end of the connector body and showing the inserter in alignment with, but spaced from, the first end.

FIG. 10 is a view looking in the direction of the arrow 10—10 of FIG. 9.

FIG. 11 is a view similar to FIG. 10 showing the inserter in its partially assembled position.

FIG. 12 is a view showing the inserter in its fully assembled position with the external conductors connected to the contact members.

FIG. 13 is a perspective view showing an assembled connector having a reed switch installed therein.

THE DISCLOSED EMBODIMENT

Figure 1:
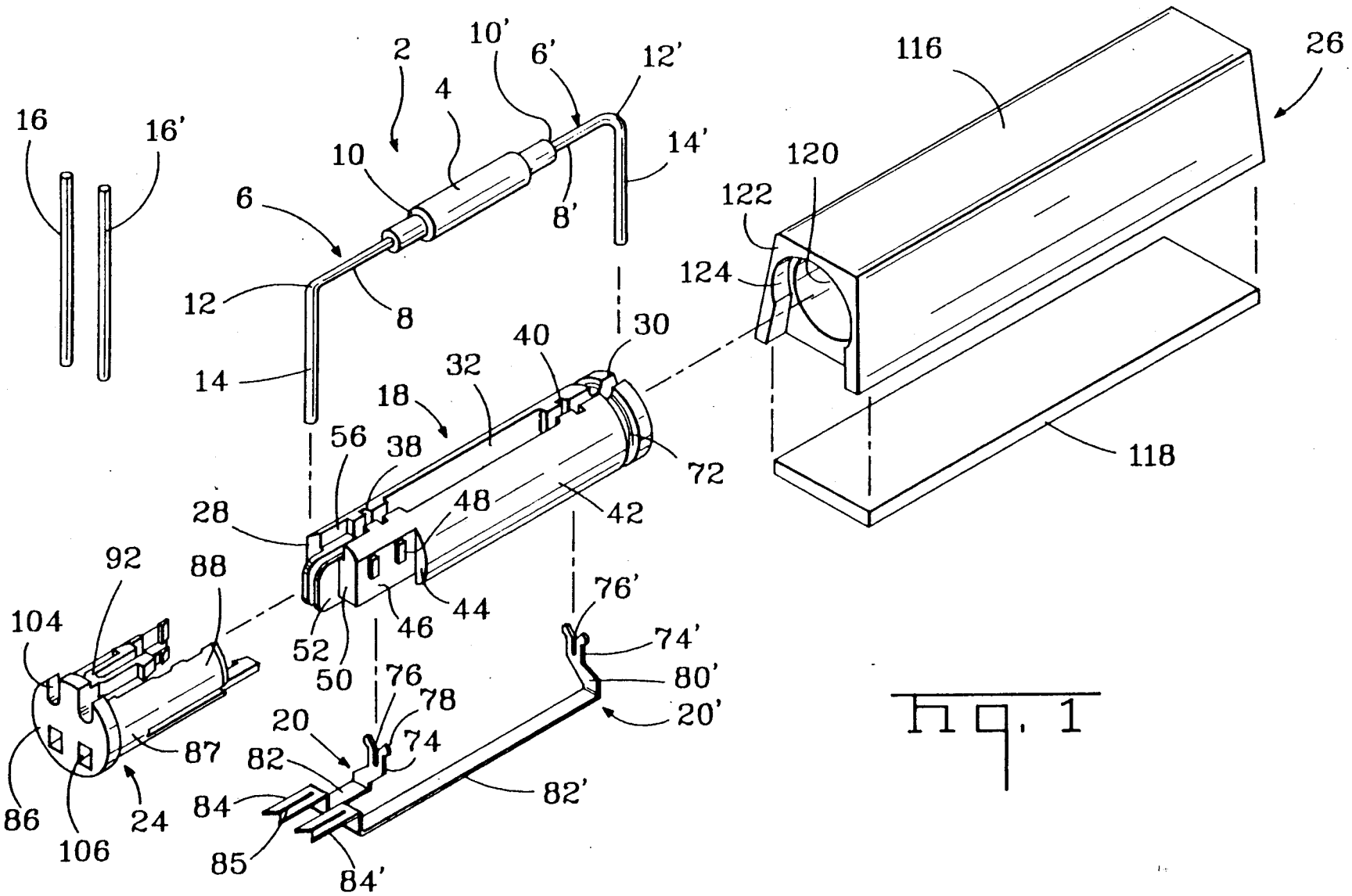
FIG. 1 is a perspective view of a connector assembly in accordance with the invention with the parts exploded from, and in alignment with, each other.
Figure 2:
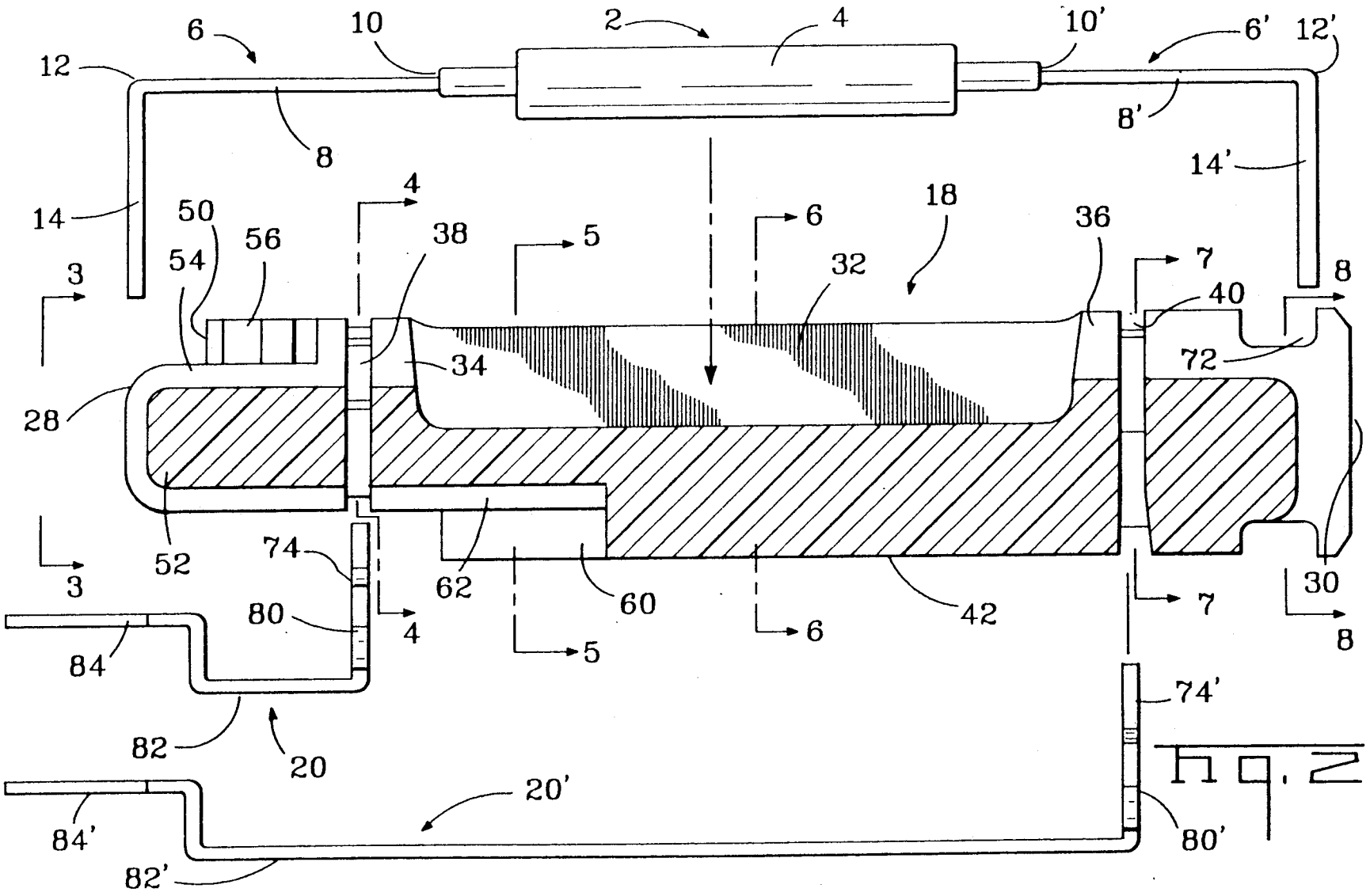
FIG. 2 is a longitudinal cross-sectional view showing the connector body, a reed switch, and first and second contact members, the reed switch and the contact members being exploded from and in alignment with, the portions of the body of which they are later located.
Figure 5:
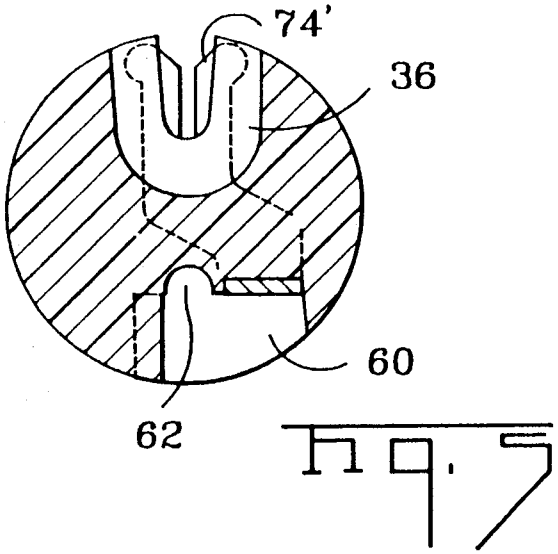
Figure 7:
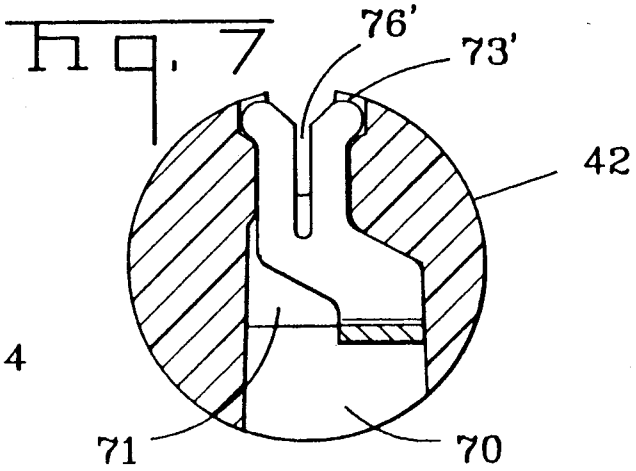

A reed switch 2, FIGS. 1 and 2, comprises a cylindrical switch body 4 having first and second wire leads 6, 6' extending from its ends 10, 10'. The wires are hermetically sealed to the body at the ends 10, 10' and it is important that this seal not be disturbed for proper operation of the switch. The leads 6, 6' are bent as shown at 12, 12' so that each lead has an adjacent portion 8, 8' which extends axially from the body 4 and a remote portion 14, 14' which extends laterally from the bends 12, 12'. The leads shown in FIGS. 1 and 2 have been bent at 12, 12' preparatory to assembly of the switch. The connector described below functions to connect the leads to first and second external conductors 16, 16'.

The connector assembly comprises a cylindrical connector body 18, first and second stamped and formed contact members 20, 20', an inserter 24, and a housing assembly 26.

The connector body 18 is of molded insulating material and generally cylindrical. The body 18 has first and second ends 28, 30 and a switch receiving cavity 32 which is between the ends. First and second lead receiving channels 34, 36 extend from the cavity towards the ends and intersect first and second contact receiving recesses 38, 40 which extend laterally through the body.

The cylindrical surface 42 of the connector body extends to shoulder surfaces 44 which face leftwardly as viewed in FIG. 1 toward the first end 28 and which merge with flat side surfaces 46 on each side of the channel. Latch ears 48 are provided on these surfaces 46 for cooperation with latch ears on the inserter 24 as will be described below. The surfaces 46 extend leftwardly in FIG. 1 to end surfaces 50 which are on each side of a nose-like projection 52. A shallow groove 54 extends from the channel through a recess 56, across the end of the projection 52 and along the underside of the connector body as shown at 62 in FIG. 2. The recess 56 extends into the connector body on each side of the groove 54 and adjacent to the contact recess as best shown in FIG. 10. The recess 56 has shoulders 58 for cooperation with latch arms on the inserter as explained below.

Figure 4:
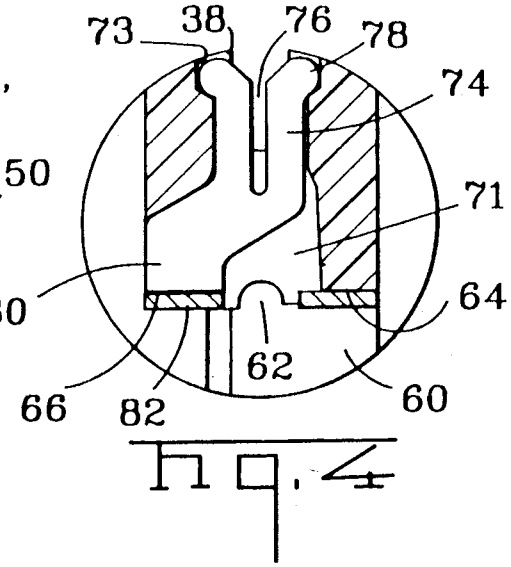
Figure 6:
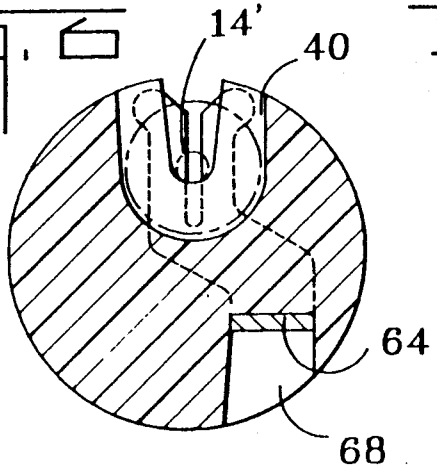
Figure 1:
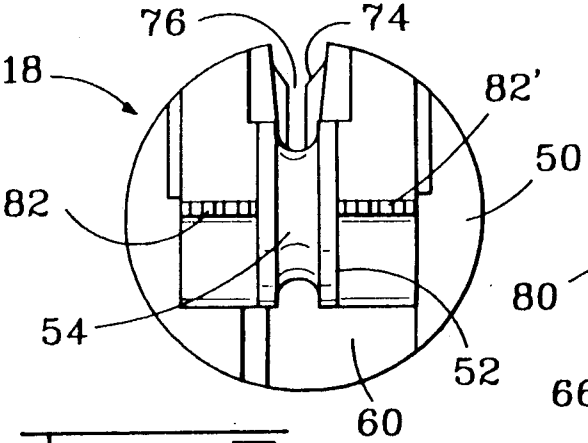
Figure 3:
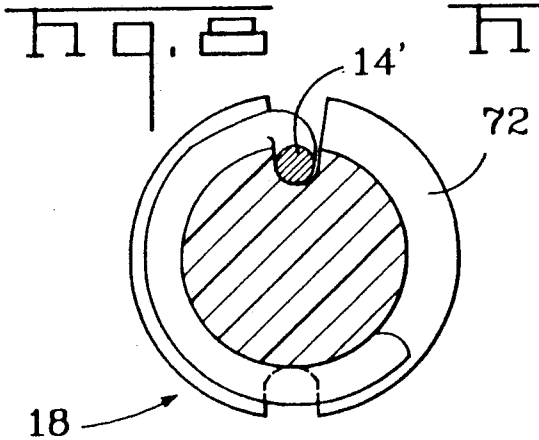
Figures 1, 7:
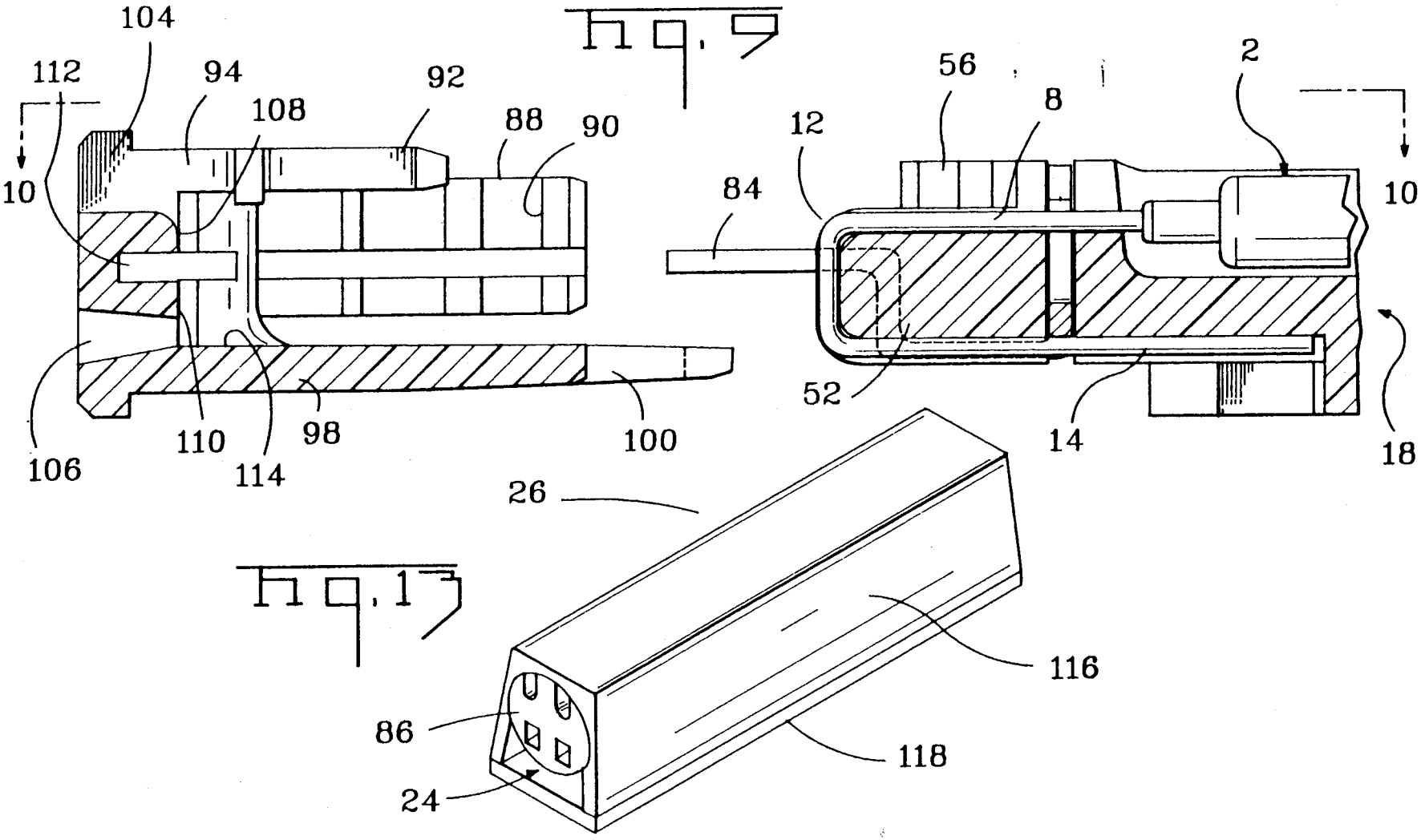

The underside of the connector body adjacent to the first end is recessed as shown at 60, FIG. 4, and has downwardly facing flat surfaces 64, 66. The surface 66 extends to the first contact recess 38 and receives the first contact member 20. The surface 64 extends towards the second end of the connector body and to the second contact recess 40. The intermediate portion of the surface 64 extends through an opening 68 in the intermediate portions of the connector body as shown in FIG. 6. The contact recesses 38, 40 are enlarged at their lower end portions 71 and contoured to accommodate the transition sections of the contact members. Also, it will be noted that the contact recesses are enlarged at 73 adjacent to the surface of the connector body to accommodate the divergent arm portions 78 of the contact members as will be described below. A circumferential groove 72 is provided in the connector body between the recess 40 and the end of the body for the storage of excess lead wire 14'.

The first contact member 20 has a lead contacting portion 74 having a wire receiving slot 76 therein and enlarged divergent ends 78 on the arms on each side of the slot. The arms merge with a transition section 80, FIG. 4, which in turn merges with an intermediate section 82 which is positioned against the surface 66. The intermediate portion in turn merges with an offset external conductor connecting portion 84 which has a wire receiving slot 85 therein for an external conductor 16.

The second contact member 20' is similar to the first contact member excepting that the intermediate portion 80' is offset in the opposite direction from that of the first contact member and the intermediate portion 82' is of a length sufficient to extend from the second contact recess to the first end 28 of the connector body so that the external conductor connecting portion 84' is located beside the portion 84 of the first contact member.

The inserter 24 comprises a circular end piece 86 having a rightwardly facing surface 89 as viewed in FIG. 10 from which latch arms 88, 92, and 100 extend. Two latch arms 88 extend from the surface 89 and are on opposite sides of the inserter. These latch arms extend from cylindrical sections 87 and have two recesses 90 on their inside surfaces for cooperation with the latch ears 48 on the surfaces 46 of the connector body. A pair of spaced apart latch arms 92 are provided on the upper portion of the inserter as viewed in FIG. 1 and extend from a common yoke 94 which is integral with the circular end section 86. The ends of the latch arms 92 have reversely extending ears 96 which are cooperable with the shoulders 58 in the recess 56 as shown in FIG. 12. The single latch arm 100 is on the opposite side of the inserter from that of the latch arms 92 and has a hook-like end 102 for cooperation with a shoulder on the housing body or the connector body. The latch arm 100 extends from a web section which provides wire stop surfaces 114 for the external conductors 16, 16'.

Slots 104 extend through the end section 86 on each side of the yoke 94 for the external conductors after they have been connected to the contact members and additional openings 106 are provided to permit inspection of the external conductors to ensure that they have been positioned against stop surfaces 114. Rightwardly facing stuffer surfaces 108, 110 are provided on the internal surface of the inserter on each side of slots 112 which receive the ends of the contact portions 84 of the contact members when the parts are fully assembled.

The housing assembly comprises a housing body 116 and a base 118. The housing body has a face 122 having an opening 120 therein through which the connector body protrudes when the parts are assembled. The base is secured to the housing body by bonding or with a hot melt adhesive or other bonding means.

The reed switch 2 is installed in the connector body 18 and the external conductors 16, 16' are connected to the leads 6, 6' of the reed switch as follows.

The contact members 20, 20' are assembled to the connector body 18 by moving them upwardly from their positions shown in FIG. 2 thereby to position the contact portions of the contact members in the recesses 38, 40 with the intermediate portions 82, 82' extending along the connector body and with the external conductor contacting portions 84, 84' in aligned coplanar relationship as shown in FIG. 10. The leads of the reed switch 2 are bent as shown at 12, 12' and the switch is moved downwardly from the position of FIG. 2 until the switch body is in the cavity 32 and the adjacent portions 8, 8' of the leads are in the channels 34, 36. Such movement of the switch will cause the leads to move into the wire receiving slots 76, 76' of the contact members thereby connecting the leads to the contact members. The excess lead wire is then positioned in the wire storage areas. The lead 6' which extends beyond the contact 74' is coiled in the circumferential recess 42. The excess portion of the lead 6 is dressed around the end of the projection 52 and positioned in the shallow groove 62 as shown in FIG. 9.

The inserter is assembled to its partially assembled position, FIG. 11, and the external conductors are then inserted as shown in FIG. 11 until they are against the stop surfaces 114 and in alignment with the wire receiving slots 85, 85' of the contact portions 84, 84'. Movement of the inserter to its fully assembled position, FIG. 12, will result in the external conductors being pushed into the wire receiving slots so that contact will be established with the contact members and, therefore, with the leads extending from the reed switch. The housing can thereafter be assembled to the connector as shown in FIG. 13. As an alternative, the reed switch can be assembled to the connector body and the inserter placed in its partially assembled position. The subassembly can then be placed in the housing in a manner such that the inserter projects beyond the face of the housing. When a technician places the switch in service, he merely inserts the wires into the inserter and pushes the inserter inwardly until the wires are inserted into the slots 85, 85'. The circular end 86 of the inserter will then be positioned in a circular recess 124 in the face of the housing.

The principles of the invention can be used by manufacturers of reed switches as a packaging method which protects the switch during handling and which avoids the necessity of having a technician handle the switch thereby simplifying the task of connecting the external conductors to the leads of the switch. The switch would, under these circumstances, be assembled to the connector body and the inserter positioned on the connector body in its partially assembled position, FIG. 11. The connector body and the inserter would then be assembled to the housing and the reed switch would be supplied to the ultimate user in this condition. The technician would then merely be required to insert the wires into the inserter and push the inserter to its fully assembled position and all manual contact with the switch itself would be avoided.

A salient advantage of the invention is that there is no necessity for cutting the leads or otherwise manipulating the leads, other than to make the bends 12, 12'. The possibility of damage to the switch is thereby minimized or completely avoided. The task of connecting the external conductors to the leads is also simplified and can be carried out by an unskilled technician without fear of damage to the switch. The inspection openings 106 provide a ready means of determining whether the connections have been properly made.

We claim:

1. A connector for connecting first and second external conductors to first and second leads which extend from an electrical component, the component comprising a component body having opposite component body ends, the first and second leads extending from the component body ends, the connector comprising:

a connector body and first and second contact members, the connector body having first and second connector body ends and a component receiving cavity which is between the connector body ends, first and second lead receiving channels extending from the cavity towards the first and second connector body ends, first and second contact recesses extending into the connector body and intersecting the first and second channels, each of the contact members having a lead contacting portion at one end, an external conductor contacting portion at the other end, and an intermediate portion extending between its ends, the lead contacting portions being in the first and second contact recesses, the intermediate portions extending from the lead contacting portion to the external conductor contacting portions at a location proximate to the first end whereby, upon placement of the component in the cavity and placement of the first and second leads in the first and second channels, the first and second leads will be connected to the first and second contact members, and the first and second external conductors can thereafter be connected to the external conductor contacting portions of the first and second contact members, characterized in that the component is a reed switch, the first and second contact recesses are spaced from the cavity by the same distance whereby electrical contact between the first and second leads and the lead contacting portions of the first and second contact members is established at the same distance from the first and second component body ends, and the connector body has first and second ends for storing the excess portions of the first and second leads which extend beyond the first and second contact recesses.

2. A connector as set forth in claim 1 characterized in that the first excess lead storage means is a groove which extends from the first contact recess to, and across, the first connector body end and then back towards the second connector body end.

3. A connector as set forth in claim 1 characterized in that the second excess lead storage means comprises a circumferential storage recess in the connector body located between the second contact recess and the second body end whereby excess portions of the second lead which extend beyond the second contact recess can be coiled in the circumferential storage recess.

4. A connector for connecting first and second external conductors to first and second leads which extend from an electrical component, the component comprising a component body having opposite component body ends, the first and second leads extending from the component body ends, the connector comprising:

a connector body and first and second contact members, the connector body having first and second connector body ends and a component receiving cavity which is between the connector body ends, first and second lead receiving channels extending from the cavity towards the first and second connector body ends, first and second contact recesses extending into the connector body and intersecting the first and second channels, each of the contact members being of stamped and formed sheet metal and having a lead contacting portion at one end, an external conductor contacting portion at the other end, and an intermediate portion extending between its ends, the lead contacting portions being in the first and second contact recesses, the intermediate portions extending from the lead contacting portion to the external conductor contacting portions at a location proximate to the first end, the lead contacting portions and the external conductor contacting portion comprising wire receiving slots, whereby, upon placement of the component in the cavity and placement of the first and second leads in the first and second channels, the first and second leads will be connected to the first and second contact members, and the first and second external conductors can thereafter be connected to the external conductor contacting portions of the first and second contact members, in combination with an external conductor inserter which is on the connector body at the first end, the inserter being in a partially assembled position and being movable to a fully in assembled position, the inserter having inserting surface portions for pushing the first and second external conductors into the external conductor contacting means when the inserter is moved to a fully assembled position.

5. A connector as set forth in claim 4 characterized in that the component is a reed switch, the first and second contact recesses are spaced from the cavity by the same distance whereby electrical contact between the first and second leads and the lead contacting portions of the first and second contact members is established at the same distance from the first and second component body ends, the connector body has first and second excess lead storage means for storing excess portions of the first and second leads which extend beyond the first and second contact recesses, the first excess lead storage means comprising a groove in the connector body which extends from the first contact recess to, and across, the first connector body end and thence back towards the second connector body end, the second lead storage means comprising a circumferential storage recess in the connector body located between the second contact recess and the second body end whereby excess portions of the second lead which extend beyond the second contact recess can be coiled in the storage recess.

6. A connector as set forth in claim 5 characterized in that the connector body is cylindrical, the inserter being in axial alignment with the connector body and being movable axially on the connector body from its partially assembled position to its fully assembled position, the inserter having external conductor stop surface portions which are adjacent to the inserting surface portions for locating the external conductors in the inserter prior to movement of the inserter from its partially assembled position to its fully assembled position.

7. A connector as set forth in claim 6 in combination with a connector housing which encloses the connector body, the housing having an opening for the inserter, the inserter extending through, and beyond, the opening when in its partially assembled position.

8. An electrical component in combination with a component connector, the component having opposite component ends and first and second leads extending from its component ends, the component and connector being characterized in that:

the connector comprises a connector body and first and second contact members, the connector body has first and second body ends, a component receiving cavity which is between the connector body ends, first and second channels which extend from the cavity axially towards the first and second connector body ends, first and second contact recesses which extend into the connector body and intersect the first and second channels, the component being in the cavity, the first and second leads extending from the cavity towards the first and second connector body ends respectively, the leads being in the channels, the first and second contact members are of stamped and formed sheet metal and are assembled to the connector body, each of the contact members has a lead contacting portion at one end thereof, an external conductor contacting portion at the other end thereof, and an intermediate portion which extends between its lead contacting portion and its external conductor contacting portion, the first contact member has its lead contacting portion connected to the first lead at a location adjacent to the first connector body end, the second contact member has its lead contacting portion connected to the second lead at a location adjacent to the second connector body end, the intermediate portions extending from the lead contacting portion to the external conductor contacting portions at a location between the first connector body end and the lead contacting portion of the first contact member, the lead contacting portions of the first and second contact members being in the first and second contact recesses respectively, whereby, first and second external conductors can be connected to the external conductor contacting portions of the contact members and thereby connected to the first and second leads when the component is placed in service, characterized in that the component is a reed switch, the first and second contact recesses are spaced from the cavity by the same distance whereby electrical contact between the first and second leads and the lead contacting portions of the first and second contact members is established at the same distance from the first and second component body ends, and the connector body has first and second excess lead storage means at the first and second connector body ends for storing the excess portions of the first and second leads which extend beyond the first and second contact recesses.

9. An electrical component in combination with a component connector as set forth in claim 8 characterized in that the first excess lead storage means comprises a groove which extends from the first contact recess to, and across, the first connector body end and thence back towards the second connector body end.

10. An electrical component in combination with a component connector as set forth in claim 8 characterized in that the second excess lead storage means comprises a circumferential storage recess in the connector body located between the second contact recess and the second connector body end whereby excess portions of the second lead which extend beyond the second contact recess can be coiled in the circumferential recess.

11. An electrical component in combination with a component connector as set forth in claim 10 characterized in that an external conductor inserter is provided which is on the connector body at the first end, the inserter being in a partially assembled position and being movable to a fully inserter assembled position, the inserter having inserting means thereon for inserting the first and second external conductors into the external conductor contacting means when the inserter is moved to a fully assembled position.

12. A reed switch in combination with a switch connector assembly, the switch comprising a cylindrical switch body having first and second lead wires extending from its ends, the switch and connector assembly being characterized in that:

the connector assembly comprises a cylindrical connector body, first and second stamped and formed contact members on the connector body, and a lead wire inserter, the connector body having first and second connector body ends and a switch receiving cavity between the ends, the reed switch being in the cavity, first and second lead receiving channels extending from the cavity towards the first and second ends, first and second contact receiving recesses between the cavity and the first and second ends respectively, the recesses extending through the body and intersecting the first and second channels, each of the contact members having an intermediate portion, a lead wire receiving slot at one of its end and an external conductor receiving slot at its other end, the first contact member having its lead wire receiving slot in the first contact receiving recess, having its intermediate portion extending to the first connector body end and having its external conductor receiving slot at the first body end, the second contact member having its lead wire receiving slot in the second contact receiving recess, having its intermediate portion extending to the first body end, and having its external conductor receiving portion at the first body end, the first and second lead wires extending in the first and second channels through the first and second contact receiving recesses and being in the lead wire receiving slots of the first and second contact members, the connector body having first and second excess wire storage means adjacent to its first and second ends for storing excess portions of the first and second lead wires which extend beyond the first and second contact receiving recesses, the first excess wire storage means comprising a groove which extends from the first contact recess to, and across, the first body end thence back towards the second body end, the second excess wire storage means comprising a circumferential storage recess in the connector body located between the second body end and the second contact receiving recess, the excess portions of the first and second lead wires being in the first and second wire storage means, the inserter being on the first body end in a partially assembled position and being movable to a fully assembled position, the inserter having insertion surface portions for pushing the first and second external conductors into the external conductor receiving slots of the first and second contact members when it is moved to its fully assembled position whereby, upon placement of the first and second external conductors in the inserter and in alignment with the external conductor receiving slots of the first and second contact members and moving the inserter to its fully assembled position, the first and second external conductors will be electrically connected to the first and second wire leads.

13. A reed switch in combination with a switch connector assembly as set forth in claim 12 characterized in that a connector housing is provided, the housing having an opening through which portions of the inserter project, the housing being otherwise in completely surrounding and enclosing relationship to the connector body and the inserter.

14. A reed switch in combination with a switch connector assembly as set forth in claim 13 characterized in that the inserter has a circular end which is adjacent to the insertion surface portions, the end having radially extending recesses on its periphery for the external conductors.

15. A reed switch in combination with a switch connector assembly as set forth in claim 14 characterized in that each of the first and second lead wires has an adjacent portion and a remote portion, the adjacent portion being adjacent to the switch body, the adjacent portion extending from the switch body through its associated channel and through its associated lead wire receiving slot, each adjacent portion extending into its associated excess lead wire storage means.

16. An assembly for use with a reed switch comprising:

a housing body having a cylindrical opening;

a cylindrical connector insertable into the cylindrical opening in the housing body, the cylindrical connector comprising a connector body and contact members for establishing electrical contact with the reed switch; wherein the cylindrical body includes a cavity open on one side of the cylindrical connector body dimensioned for mounting a reed switch in the cavity; and the contact members each include means for establishing electrical contact with one reed switch lead and means for establishing electrical contact with an external conductor, the means for establishing electrical contact with a reed switch lead and the means for establishing electrical contact with an external conductor being located on opposite ends of the contact member, and the contact members are mounted on the cylindrical body to establish electrical contact with the reed switch so that electrical contact with the reed switch can be established before the cylindrical connector is inserted into the housing body, wherein the cylindrical connector includes an inserter shiftable relative to the cylindrical connector body, the inserter being positioned for establishing electrical contact with external conductors on the contact members when the inserter is shifted relative to the cylindrical connector.

17. The assembly of claim 16 wherein the means for establishing electrical contact with the reed switch leads and the means for establishing electrical contact with an external conductor comprise wire receiving slots.

18. An assembly for use with a reed switch comprising:

a housing body having a cylindrical opening;

a cylindrical connector insertable into the cylindrical opening in the housing body, the cylindrical connector comprising a connector body and contact members for establishing electrical contact with the reed switch; wherein the cylindrical body includes a cavity open on one side of the cylindrical connector body dimensioned for mounting a reed switch in the cavity; and the contact members are mounted on the cylindrical body to establish electrical contact with the reed switch so that electrical contact with the reed switch can be established before the cylindrical connector is inserted into the housing body, wherein lead storage means communicating with the cavity are provided on the exterior of the connector body.

19. The assembly of claim 18 wherein the lead storage means comprise channels communicating with the cavity.

20. An assembly for use with a reed switch comprising:

a housing body having a cylindrical opening;

a cylindrical connector insertable into the cylindrical opening in the housing body, the cylindrical connector comprising a connector body and contact members for establishing electrical contact with the reed switch; wherein the cylindrical body includes a cavity open on one side of the cylindrical connector body dimensioned for mounting a reed switch in the cavity; and the contact members are mounted on the cylindrical body to establish electrical contact with the reed switch so that electrical contact with the reed switch can be established before the cylindrical connector is inserted into the housing body, wherein the cylindrical connector includes an inserter releasably latched in a first position relative to the connector body and shiftable from the first position to a second position to interconnect external conductors to the contact members.

21. An assembly for use with a reed switch comprising:

a housing body having a cylindrical opening;

a cylindrical connector insertable into the cylindrical opening in the housing body, the cylindrical connector comprising a connector body and contact members for establishing electrical contact with the reed switch; wherein the cylindrical body includes a cavity open on one side of the cylindrical connector body dimensioned for mounting a reed switch in the cavity; and the contact members are mounted on the cylindrical body to establish electrical contact with the reed switch so that electrical contact with the reed switch can be established before the cylindrical connector is inserted into the housing body, wherein the cylindrical opening comprises a bore having substantially the same length as the cylindrical connector so that the cylindrical connector can be fully inserted into the cylindrical bore.

* * * * *